US005694861A

United States Patent [19]

Laukamm-Josten

[11] Patent Number: 5,694,861

[45] Date of Patent: Dec. 9, 1997

[54] DESK WITH SUPPORTED COMPUTER MONITOR

[76] Inventor: Ulrich Laukamm-Josten, Windscheidstrasse 21, D-10627 Berlin, Germany

[21] Appl. No.: 443,114

[22] Filed: May 17, 1995

[30] Foreign Application Priority Data

May 18, 1994 [DE] Germany ..... 44 17 873.5

[51] Int. Cl.[6] ..... A47B 5/00

[52] U.S. Cl. ..... 108/50; 312/223.3; 248/923; 248/324

[58] Field of Search ..... 108/50, 23, 28; 248/922, 923, 917, 324; 312/223.3, 194, 196

[56] References Cited

U.S. PATENT DOCUMENTS

| | | | |
|---|---|---|---|
| 5,071,204 | 12/1991 | Price et al. | 312/223.3 X |
| 5,094,514 | 3/1992 | Grosch | 312/223.3 X |
| 5,118,172 | 6/1992 | Ugalde | 312/223.3 |
| 5,139,223 | 8/1992 | Sedighzadeh | 248/324 |
| 5,290,099 | 3/1994 | Lechman | 312/223.3 X |
| 5,294,193 | 3/1994 | Wegman et al. | 312/223.3 |
| 5,410,972 | 5/1995 | Schairbaum | 108/50 |

FOREIGN PATENT DOCUMENTS

| | | | |
|---|---|---|---|
| 2 261 035 | 6/1974 | Germany . | |
| 3516855 | 11/1986 | Germany | 312/223.3 |
| 4200965 | 7/1992 | Germany | 312/223.3 |
| 8503626 | 8/1985 | WIPO | 312/223.3 |
| WO25117 | 12/1993 | WIPO | 312/223.3 |

*Primary Examiner*—Jose V. Chen
*Attorney, Agent, or Firm*—McGlew and Tuttle

[57] ABSTRACT

A desk with a working top, in which a window with approximately the area dimensions of a display monitor screen is recessed. The monitor housing can be supported in the area of the window by a holding structure provided with holding straps in a slightly inclined position in the direction of the front edge of the window. To simplify the holding structure, the holding straps are attached to suspension elements, which are located under the working top in front of the front edge and behind the rear edge of the window. The straps can be displaced and locked in a direction at right angles to the front and rear edges of the window, and the distance between the suspension elements and the holding straps attached to them is smaller than the width of the rear wall of the display screen housing to be accommodated by the holding straps.

15 Claims, 3 Drawing Sheets

DESK WITH SUPPORTED COMPUTER MONITOR

FIELD OF THE INVENTION

The present invention pertains to a desk with a working top with a window of approximately the area dimension of a display screen, the housing of such a display screen being accommodated in the area of the window by a holding structure including straps in a somewhat inclined position extending in the direction of the front edge of the window.

BACKGROUND OF THE INVENTION

A desk of this class has been known from WO 88/07826. The holding device provided with holding straps consists of an adjustable, multipart rod assembly, in which a base plate carrying the housing of the display screen is held by holding straps, and the angular and height setting of the display screen can be changed by the user by making an adjustment as desired. The housing of the display screen may also be suspended by means of holding straps only, without a technically usable solution being disclosed for this. The high mechanical expense for the holding device, which greatly increases the costs of the desk, is disadvantageous here.

SUMMARY AND OBJECTS OF THE INVENTION

The primary object of the present invention is to simplify the holding device provided with holding straps for the display screen housing.

To attain this object, the present invention provides for the holding straps to be attached to support points, which are located under the working top in front of the front edge and behind the rear edge of the window. The holding straps can be displaced and locked in a direction at right angles to the front and rear edges of the window. The distance between the suspensions and the holding straps attached to them is smaller than the width of the rear wall of the display screen housing to be supported by the holding straps. A simple holding device is provided as a result, with which the angular position and the height of the display screen can be changed by the user as desired by displacing the support points. The holding device can also be manufactured in a simple manner in terms of costs. A subsequent retrofitting of desks of any type is also possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
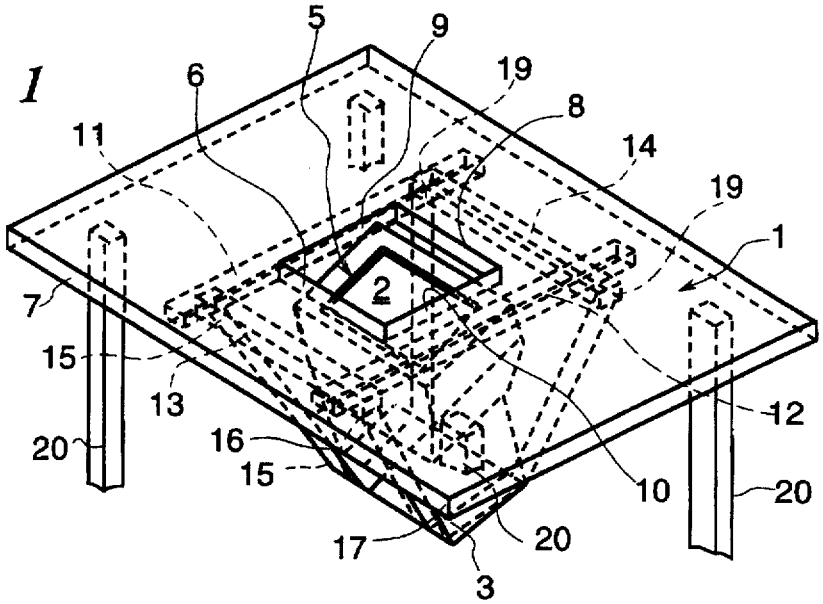
FIG. 1 is a perspective top view of the working top of the desk with a display screen hanging in holding straps.
Figure 2:
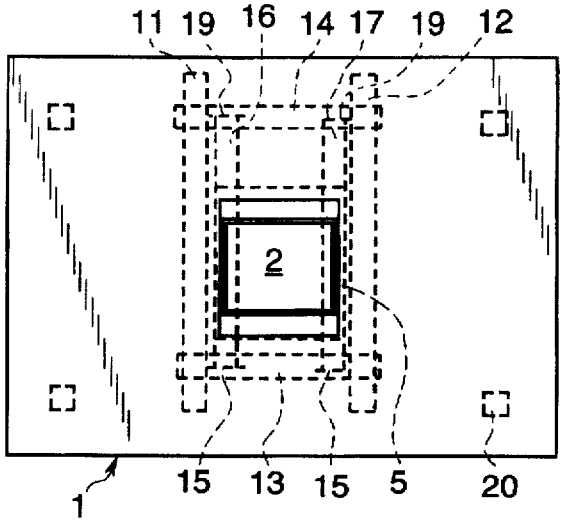
FIG. 2 is a top view of the desk.
Figure 3:
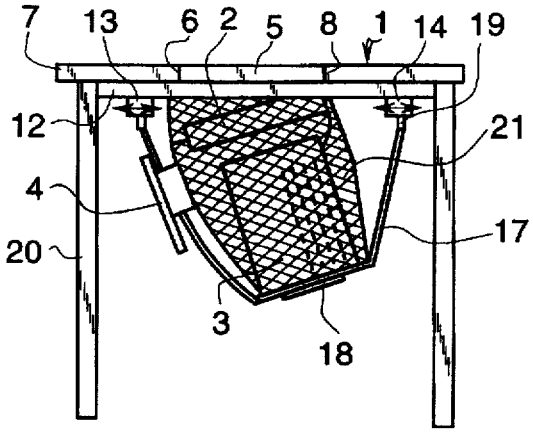
FIG. 3 is a side view of the desk.

Referring to the drawings in particular, the desk of the invention is comprised of a working top 1 with desk legs 20, a monitor including a display screen 2 with a housing 3 and a foot 4, as well as a keyboard (not shown in FIGS. 1–3). A window 5 approximately with the area dimensions of the display screen 2 is recessed in the working top 1, preferably in the middle or in any desired area, and the area left between the front edge 6 of the window 5 and the front edge or user side 7 of the work table 1 is used to accommodate the keyboard (not shown in FIGS. 1–3). To do so, the distance between the front edge 6 of the window 5 and the front edge 7 of the working top 1 is approximately 20 to 30 cm. The rear edge 8 of the window 5 extends approximately at the distance of the height of the display screen 2 from and in parallel to the front edge 6 of the window 5.

Figure 7:
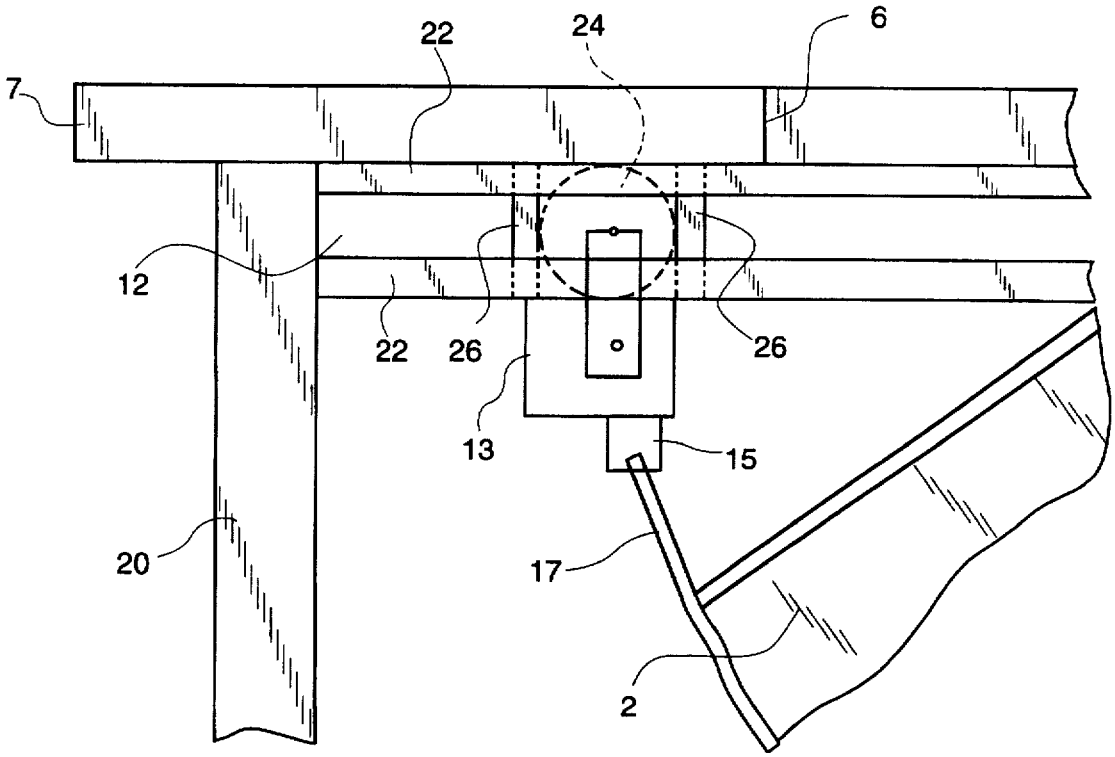
FIG. 7 is an enlarged view of a portion of the desk.

Two frame supports 11, 12, which extend in parallel to one another and on which two strap supports 13, 14 extending in parallel to the front and rear edges 6, 8 of the window 5 are displaceably mounted, are attached under the working top 1 in parallel to the side edges 9, 10 of the window 5, and displaceability at right angles to the front and rear edges 6, 8 of the window 5 is possible. The displaceability of the strap supports 13, 14 on the frame supports 11, 12 may be ensured by displacement means including rails 22 and rollers 24 fixed on them (as shown in FIG. 7). Locking means (26) for fixing the displaceable strap supports 13, 14 on the fixed frame supports 11, 12 are provided as well.

The strap supports 13, 14, which are displaceable in parallel on the frame supports 11, 12, support, on their undersides, suspensions 15, 19 for tensioning or stretch straps 16, 17, which extend in a curved shape, as is shown in FIG. 3, in the plane of the frame supports 11, 12 between the two strap supports 13, 14. The tensioning straps or stretch 16, 17 consist of a fabric material of sufficient strength for accommodating the display screen 2 and its housing 3. The tensioning straps 16, 17 may also be locked automatically.

The distance between the two tensioning straps 16, 17 is smaller than the width of the front side of the housing 3 of the display screen 2, so that the housing 3 can be held by the two tensioning straps 16, 17, as is shown especially in FIG. 3. The foot 4 of the display screen 2 extends between the two tensioning straps 16, 17 in the direction of the front edge 7 of the work table 1. The display screen 2 is in an inclined position at an angle of approx. 30° to the surface of the working top 1, as is shown in FIG. 3. Since the display screen 2 with its housing 3 hangs freely in the tensioning straps 16, 17 in the nontensioned or non stretched state, a nearly freely selectable position of the display screen 2 in relation to the working top 1 and consequently to the window 5 recessed therein is possible. The tensioning straps 16, 17 are then tensioned or stretched by displacing the suspensions 15, 19, and this make possible a slip-free fixation of the display screen 2 at a freely selectable angle in relation to the working top 1, this fixation is made possible by pressing the display screen to the underside of the working top 1 at least at one edge of the window 5 or at an edge of the frame support 11, 12 extending at right angles thereto. On releasing the tensioning straps 16, 17, the display screen 2 again hangs freely, and the angle of the display screen 2 in relation to the working top 1 can again be adjusted.

The distance between the two tensioning straps 16, 17 must be smaller than the front side of the display screen 2 in order to accommodate the latter. A loop or back strap 18, which connects the two tensioning straps 16, 17, is arranged in the form of a ring or the like on the rear side of the usually narrower housing 3 of the display screen 2. This loop 18 holds together the two tensioning straps 16, 17 and prevents the display screen 2 from slipping laterally off the tensioning straps 16, 17.

The suspensions 15, 19 may also be directly and firmly fixed on the underside of the working top 1, and the suspensions 15 are attached approximately at a height just in front of the front edge 6 of the window 5, and the suspensions 19 are attached behind the rear edge 8 at a distance that approximately corresponds to the distance between the front edge 6 and the rear edge 8.

Figure 4:
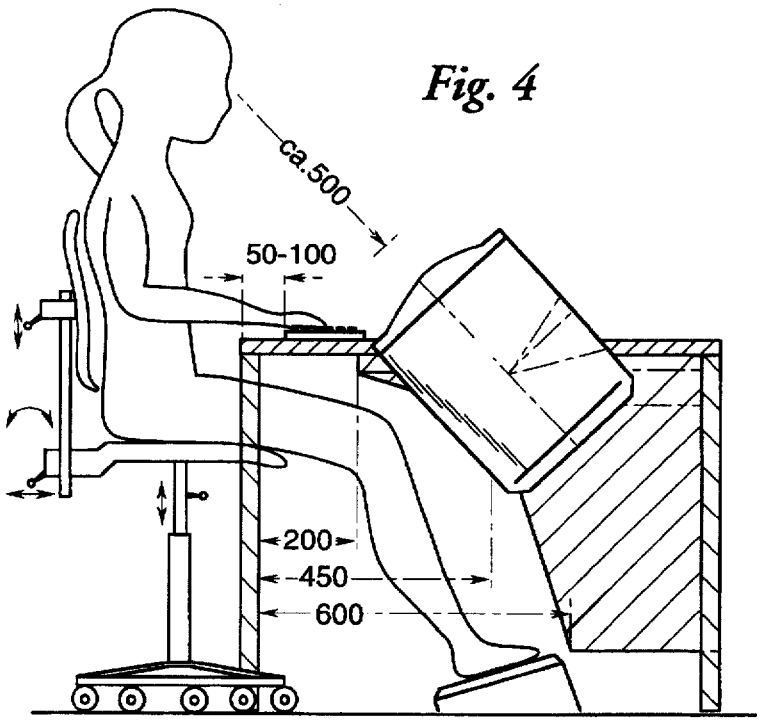
FIG. 4 is a side view of the desk according to FIG. 3 with the display screen in a raised position and with an operator.
Figure 5:
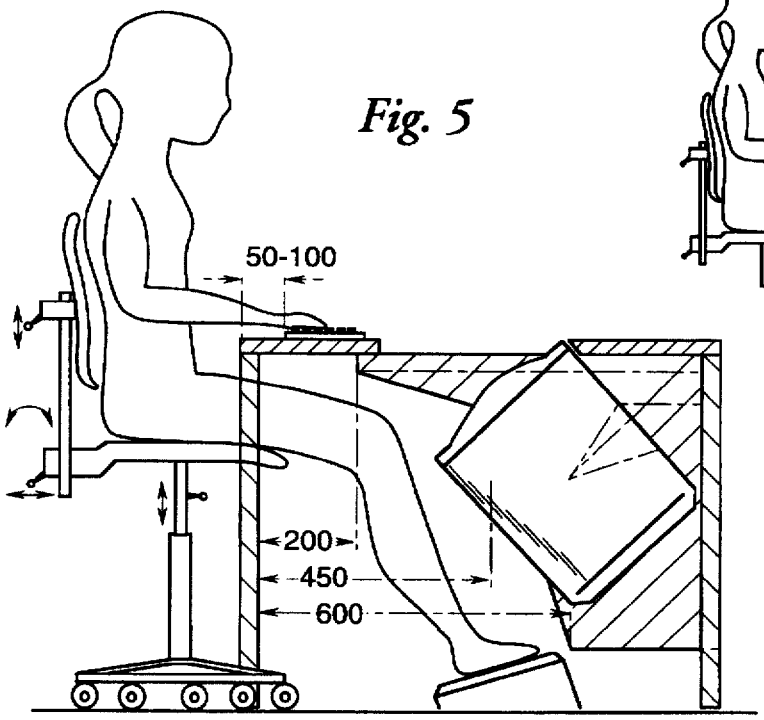
FIG. 5 is a representation corresponding to FIG. 4 with lowered display screen.

FIGS. 4 and 5 show different arrangements of the display screen housing 3 with the display screen 2 located above (FIG. 4) or below (FIG. 5) the working top 1. The holding straps 16, 17 are not shown here.

Figure 6:
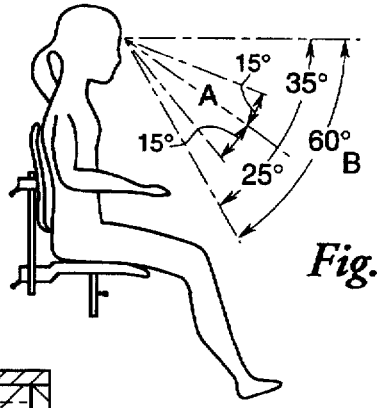
FIG. 6 is a view showing the limits of the field of vision of the operator.

FIG. 6 shows the limits of the field of vision of the operator, with area A indicating the optimal field of vision, in which the display screen 3 can be optimally adjusted by means of the holding straps 16, 17.

A Faraday cage, which reduces or completely eliminates electromagnetic radiation of the display screen housing 3 on all sides except to the front side, can be formed by a combination of the frame, formed by the frame supports 11, 12 and the strap supports 13, 14, and the tensioning straps 16, 17 with a metallic netting, a mesh foil 21 (FIG. 3) or a metallic housing.

While a specific embodiment of the invention has been shown and described in detail to illustrate the application of the principles of the invention, it will be understood that the invention may be embodied otherwise without departing from such principles.

What is claimed is:

1. A desk, comprising a working top with a window, a monitor with a display screen, the window having an area dimension approximately corresponding to said display screen, said monitor including a housing disposed adjacent to an area of said window; holding means including tensioning straps for holding said monitor in a slightly inclined position and suspension elements located under said working top, said tensioning straps being attached to said suspension elements, said suspension elements being connected to said working top at a location in front of a front edge of said window and behind a rear edge of said window, a distance between said suspension elements, and a distance between tensioning straps attached to said suspension elements is smaller than a width of said monitor housing whereby said monitor housing is accommodated by said tensioning straps;

means for displacing said suspension elements in a direction at right angles to a front and rear edge of said window.

2. A desk according to claim 1, further comprising means for locking said suspension elements in position.

3. A desk in accordance with claim 1, wherein:

said tensioning straps are stretch straps to bias said motor against said working top.

4. A desk comprising:

a desk top with a window;

a monitor positioned adjacent said window, said monitor having a display screen with a size approximately corresponding to a size of said window;

holding means positioned on said desk top and for holding said monitor adjacent said window, said holding means including a plurality of straps, a first end of said plurality of straps being connected to said desk top adjacent a first side of said window by a suspension element, a second end of said plurality of straps being connected to said desk top adjacent a second side of said window by another suspension element, said suspension elements being mounted on said desktop on opposite sides of said window, a distance between said straps being smaller than a width of said monitor to support said monitor by said straps;

displacement means for movably connecting said suspension elements to said desk top in a direction substantially perpendicular to said first and second sides.

5. A desk in accordance with claim 4, further comprising:

locking means for locking said suspension elements in a fixed position to said desk top.

6. A desk in accordance with claim 4, wherein:

said desk top has a user side adjacent a user of the desk and said first side of said window is adjacent said user side.

7. A desk in accordance with claim 4, wherein:

said holding means is holdable of said monitor in a plurality of angular positions.

8. A desk in accordance with claim 4, wherein:

said monitor has a housing and said straps wrap around said housing.

9. A desk in accordance with claim 4, wherein:

said monitor includes a foot, and said foot extends between said straps.

10. A desk in accordance with claim 4, wherein:

said holding means includes a back strap extending from one of said straps to another of said straps, said back strap being contactable with a back of said monitor.

11. A desk in accordance with claim 4, further comprising:

a Faraday cage attached to one of said desk top and said holding means for reducing electromagnetic radiation from said monitor.

12. A desk in accordance with claim 4, wherein:

said holding means biases said monitor against said desk top.

13. A desk in accordance with claim 4, wherein:

said straps have means for stretching and contracting to bias said monitor against said desktop.

14. A desk in accordance with claim 4, wherein:

said holding means biases said monitor between said desk top and said plurality of straps.

15. A desk in accordance with claim 1, wherein:

said tensioning straps are stretch straps to bias said monitor between said working top and said stretch straps.

* * * * *